US005620329A

United States Patent [19]

Kidd et al.

[11] Patent Number: 5,620,329

[45] Date of Patent: Apr. 15, 1997

[54] SELF-ALIGNING ELECTRICAL CONNECTIVE ARRANGEMENT

[75] Inventors: Richard L. Kidd, Stow; Paul Di Liello, Cortland; David G. Siegfried, Vienna; Anthony J. Corso, Struthers, all of Ohio; Robert W. Rimko, Transfer, Pa.; Bobbi S. Dankert, Cicero, Ind.

[73] Assignees: General Motors Corporation, Detroit, Mich.; Delco Electronics Corp., Kokomo, Ind.

[21] Appl. No.: 664,357

[22] Filed: Jun. 17, 1996

[51] Int. Cl.[6] ..... H01R 13/64

[52] U.S. Cl. ..... 439/248; 439/496; 439/378

[58] Field of Search ..... 439/248, 496, 439/77, 378

[56] References Cited

U.S. PATENT DOCUMENTS

| | | | |
|---|---|---|---|
| 3,154,365 | 10/1964 | Commins | 434/496 |
| 3,432,802 | 3/1969 | Ritchie | 439/557 |
| 4,389,021 | 6/1983 | Coldren | 439/545 |
| 4,812,133 | 3/1989 | Fleak et al. | 439/248 |
| 5,083,939 | 1/1992 | Ittah | 439/496 |
| 5,514,000 | 5/1996 | Krause et al. | 439/557 |

*Primary Examiner*—Neil Abrams
*Assistant Examiner*—T. C. Patel
*Attorney, Agent, or Firm*—Ernest E. Helms

[57] ABSTRACT

A blind assembly electrical connective arrangement is provided for mating an electrical component with a first structure to a flexible circuit, the flexible circuit being positioned adjacent a second structure, the second structure having first and second surfaces penetrated by an aperture, the arrangement including a male slider, the slider having a platform projecting in a first direction, the platform providing a presentation surface for the flexible circuit, the slider also having at least one set of fingers juxtaposing the second structure, at least one of the fingers being compliant, and the male slider also having an alignment post; and a female housing connected with the electrical component, the female housing having a cavity to receive the platform in the alignment post of the male slider, the female housing having at least one terminal biased for contact with the flexible circuit and wherein movement of the electrical component in a second direction opposite the first direction toward the second structure causes the slider to move in a first plane to align itself with the female housing and to establish an electrical connection.

8 Claims, 3 Drawing Sheets

SELF-ALIGNING ELECTRICAL CONNECTIVE ARRANGEMENT

FIELD OF THE INVENTION

The field of the present invention is that of electrical connective arrangements, particularly those which are useful in establishing an electrical connection between automotive electrical devices and a flexible circuit which is electrically connected with the remainder of the vehicle electrical system.

BACKGROUND OF THE INVENTION

The use of flexible circuits in the automotive environment is well known. Flexible circuits typically have a plastic film, such as Mylar, which encapsulate a flexible metal conductor. Flex circuit connectors are typically made by mating two connector halves, one on the device and one on the flex circuit. Prior connections require the operator to visually observe the two connector halves during mating and subsequent locking. Other prior methods include a terminal on the device or harness which mates to a trace on the flex circuit which is typically backed up by a nonconductive substrate. In most prior methods, visual observation by the assembly operator is usually required and the connector halves usually lock together. Usually, mating the connector halves cannot be done blindly due to potential misalignment, circuit damage or failure to achieve mating and locking.

It is desirable to have an electrical connective arrangement wherein the physical connection of an electrical component, (such as, but not limited to, a heating ventilation and air conditioning control module, or a sound system module including a radio and cassette player) is automatically made when the electrical component is physically connected with a vehicle dashboard or other vehicle modules, such as doors and headliners.

SUMMARY OF THE INVENTION

The present invention brings forth an electrical connective arrangement suitable for blind assembly wherein physical attachment of the electrical component to a vehicle dashboard (or other vehicle modules) simultaneously establishes an electrical connection with the electrical component and a vehicle electrical system flexible circuit. The arrangement, in a preferred embodiment, includes a male slider having a platform providing a presentation surface for the flexible circuit. The male slider also has at both ends a set of fingers juxtaposing a wall structure with the remainder of the male slider overlapping a slot in the wall structure. The male slider also has vertically and horizontally tapered alignment posts.

A female housing is connected with the electrical component. The female housing has a cavity to receive the platform and alignment posts of the male slider. The female housing additionally has terminals biased for contact with the flexible circuit when the electrical device is moved toward the slider. The interaction of the alignment posts within the cavity of the female housing causes the slider to move in a plane in two translational axes to align itself with the female housing to establish an electrical connection upon insertion of the electrical device in the vehicle dashboard.

Other advantages of the present invention will be apparent to those skilled in the art as the invention is brought forth in the accompanying drawings and detailed description.

DETAILED DESCRIPTION OF THE DRAWINGS

Figure 1:
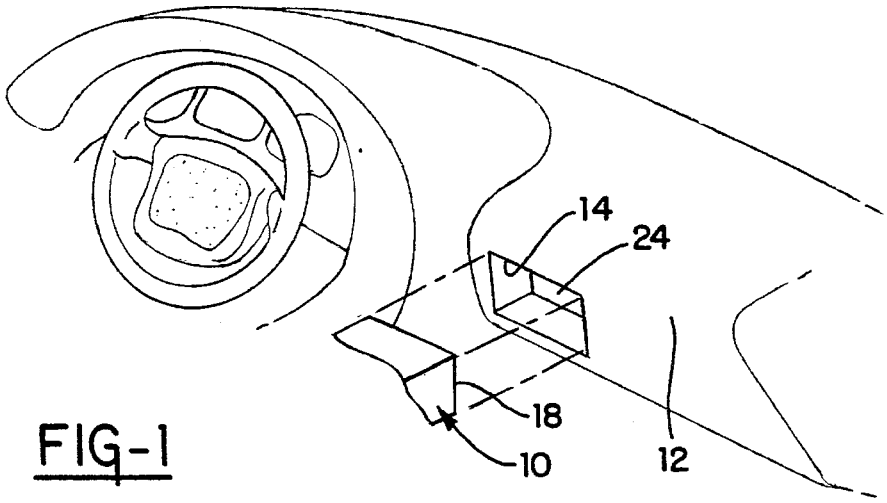
FIG. 1 is a perspective view of an interior of an automotive vehicle showing insertion of an electrical component into a vehicle dashboard.

FIG. 1 illustrates an interior of an automotive vehicle having an electrical component 10 which is insertable into an automotive dashboard 12. The dashboard has an opening 14. Referring additionally to FIGS. 2 through 6, the blind assembly electrical connective arrangement 7, according to the present invention, has a female housing 16 which is connected with a first structure 18 provided by the electrical component 10.

The connective arrangement 7 also has a male slider 20 which is mounted within a T-shaped aperture 22 of a second structure 24 typically provided by an interior wall of the dashboard 12. The second structure 24 has a first side 26 which faces the electrical component 10 and a second side 28 opposite the electrical component 10 and its associated female housing 16.

The male slider 20 is made from a rigid plastic or metal material. The male slider 20 has a platform 30 which provides an upper presentation surface 32 and a lower presentation surface 34. The platform 30 extends generally in a first direction toward the electrical component 10.

The platform 30 has a series of attachment bumps 36. The attachment bumps are on the upper presentation surface 32 and lower presentation surface 34, as well as along a frontal edge 38. A flexible circuit 40 is brought along the second side 28 of the second structure and is attached to the male slider 20 via the attachment bumps 36. The attachment bumps 36 are configured to have a diameter slightly larger or equal to the apertures prepunched into the flexible circuit 40. After being wrapped around the platform 30, the flexible circuit is then returned to the second side of the second structure 28.

The flexible circuit 40 is etched to expose the encased metallic conductors along linearly extending locations 42 on both the upper presentation surface 32 and lower presentation surface 34 of the male slider 20.

Figure 2:
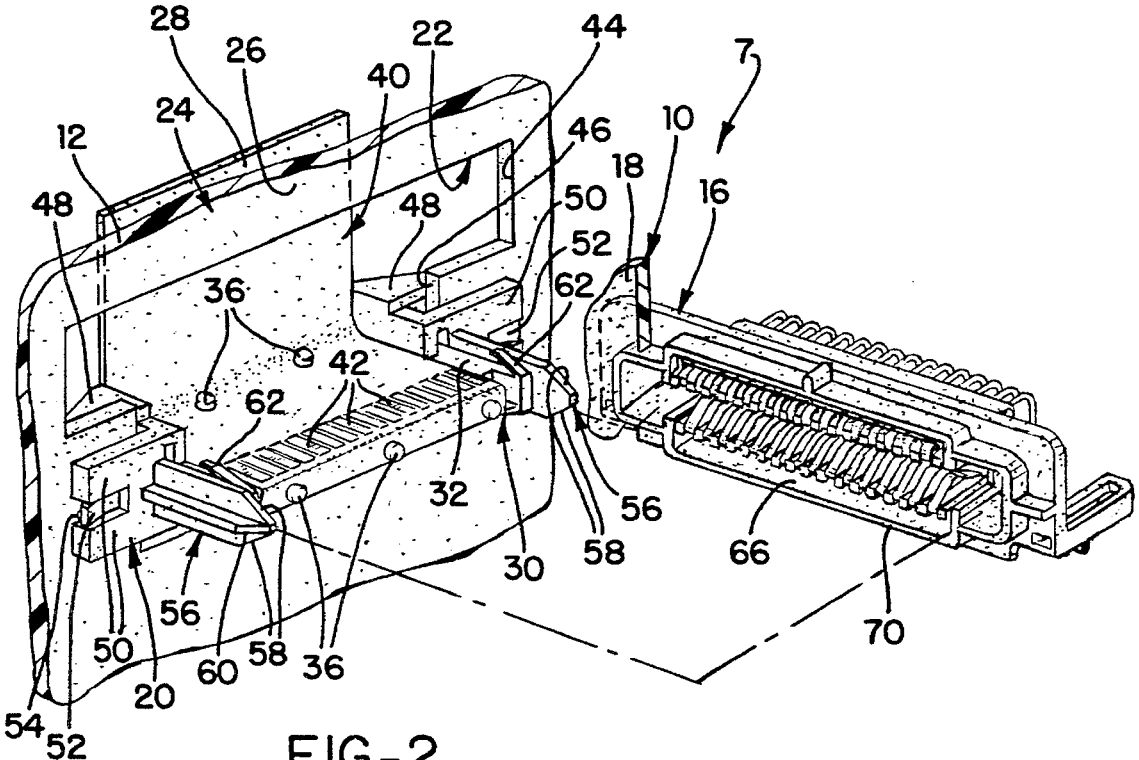
FIG. 2 is a perspective view illustrating placement of a male slider of the present invention into an aperture on a structural wall of the vehicle with the housing portion of the present inventive electrical connective arrangement being exploded away for clarity of illustration.
Figure 3:
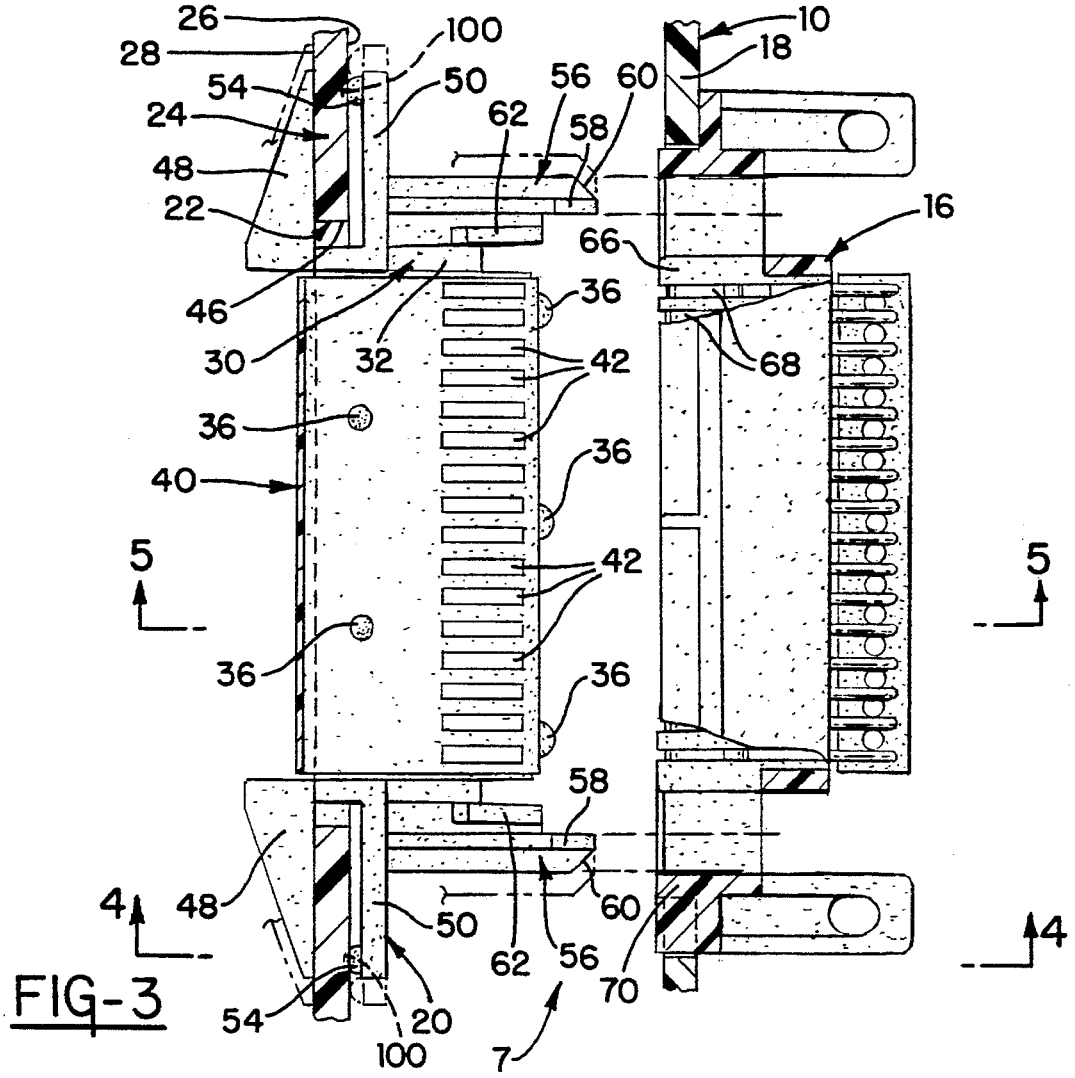
FIG. 3 is a top plane elevational view of the electrical connective arrangement as shown in FIG. 2.
Figure 4:
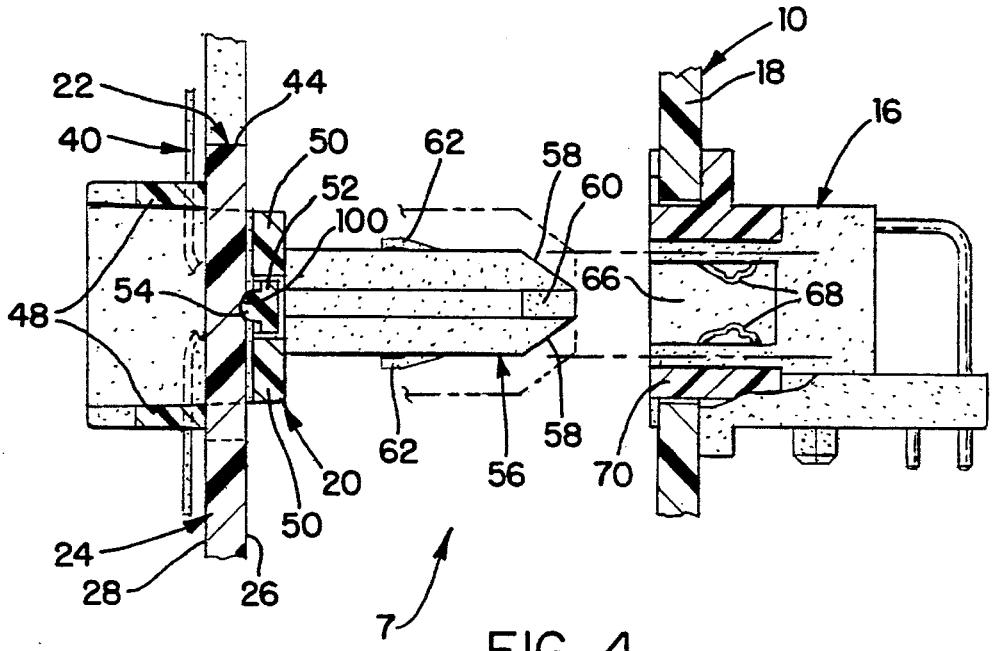
FIGS. 4 and 5 are taken along lines 4—4 and 5—5, respectively, of FIG. 3.
Figure 5:
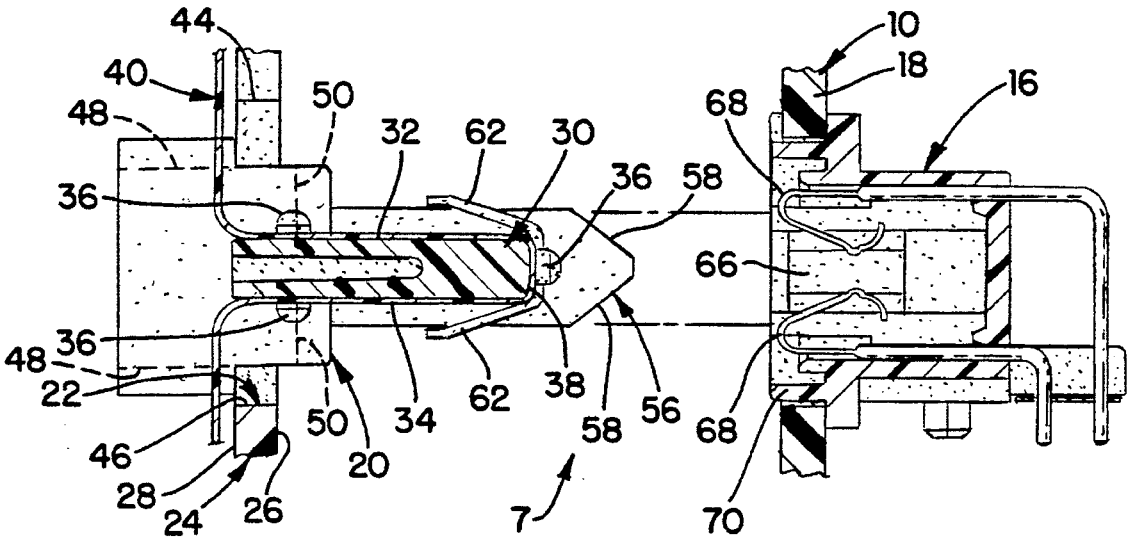
Figure 6:
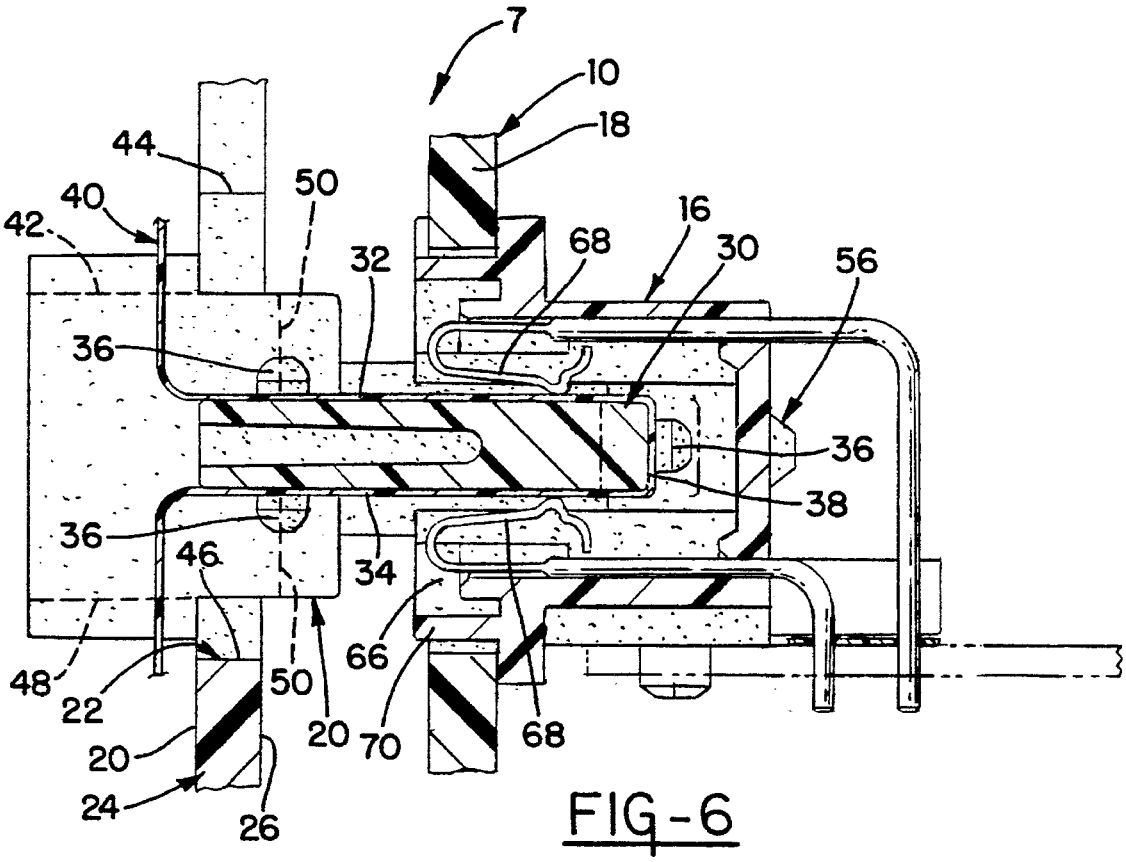
FIG. 6 is an enlarged view similar to that of FIG. 5 after the male slider and the female housing have been mated for electrical connection.

The second structure 24 and T-shaped aperture 22 has a major transverse portion 44 joined to a minor transverse dimension portion 46. The male slider is first inserted in portion 44 and is then pushed downwardly into portion 46. As shown in FIG. 2, both ends of the male slider have two sets of forward fingers 48 and rear fingers 50 with part of the second structure 24 juxtaposed therebetween. Additionally, on the rearward side, there is a compliant finger 52 having a balled nail 54 ensuring a grip into a socket 100 upon the second structure 24. The grip provided by rear fingers 50, compliant finger 52 and forward fingers 48 ensure that the male slider 20 is retained in its installed position unless a force is exerted upon it.

Along both ends of the male slider 20 are alignment posts 56. The alignment posts have vertical tapered surfaces 58 and transverse or horizontal tapered surfaces 60.

To aid in the stability in establishing electrical connection, there is a spring tab 62 adjacent to both of the alignment posts 56.

Referring to FIG. 2, the female housing 16 is a rigid nonconductive material and has a cavity 66 which accommodates the alignment posts 56, spring tab 62 and platform 30 of the male slider. The female housing 16 also mounts a plurality of spring leads 68 to provide the terminals which electrically mate with locations 42 of the flexible circuit 40.

During the vehicle assembly operation, the flexible circuit 40 will be connected with the male slider 20, and the male slider will be positioned appropriately within portion 46 of the aperture 22. The electrical component 10, during a later stage of assembly operation, will then be inserted within the opening 14 in a direction generally opposite the direction of extension of the platform 30. The male slider 20 will have approximately ±3.0 mm transverse compliance and ±3.00 vertical compliance.

The female housing cavity 66 has an outer rim 70. As long as rim 70 can make contact with the tapered surfaces 58 or 60, movement of the electrical component 10 into the opening 14 will cause the male slider 20 to move in a plane generally parallel with the second structure 24 to align itself with the female housing 16.

Compliance in the orientation of travel of the electrical component 10 within the opening 14 will be established by the locking tolerance of electrical component 10 to the opening 14 or aperture 22, typically ±2.5 mm. The locking tolerance will be less than the length of locations 42 of the flexible circuit 40. As mentioned previously, the spring tab 62 will provide stability to the connective arrangement 7. Since the locational compliance provided by the connective arrangement 7 in all planes will be greater than any locational tolerances in the physical attachment of the electrical component 10 with the dashboard 12, physical connection of the electrical component 10 with the dashboard 12 will simultaneously assure electrical connection with the electrical component 10 with the flexible circuit 40.

The present inventive blind assembly electrical connective arrangement 7 is highly useful where connective accessibility or visibility is limited.

While this invention has been described in terms of a preferred embodiment thereof, it will be appreciated that other forms could be adapted by one skilled in the art. Accordingly, the scope of this invention is to be considered limited only by the following claims.

What is claimed is:

1. An electrical connective arrangement for mating an electrical component with a first structure to a flexible circuit, the flexible circuit being positioned adjacent a second structure, the second structure having first and second surfaces penetrated by an aperture, the arrangement comprising:

a male slider, the slider having a platform projecting in a first direction, the platform providing a presentation surface for the flexible circuit, the slider also having at least one set of fingers juxtaposing the second structure, at least one of the fingers being compliant, and the male slider also having an alignment post; and a female housing connected with the electrical component, the female housing having a cavity to receive the platform in the alignment post of the male slider, the female housing having at least one terminal biased for contact with the flexible circuit and wherein movement of the electrical component in a second direction opposite the first direction toward the second structure causes the slider to move in a first plane to align itself with the female housing and to establish an electrical connection.

2. An electrical connective arrangement as described in claim 1 wherein the flexible circuit is positioned on a side of the second structure primarily opposite the electrical component.

3. An electrical connective arrangement as described in claim 1 wherein there are two sets of fingers on opposites of the male slider and wherein there is a T-shaped slot on the second structure and the male slider can be mounted to the second structure by entrance into the T-shaped slot and then moved to be in position to place the set of fingers on the opposite side of the slider to juxtapose the slot.

4. An electrical connective arrangement as described in claim 1 further including at least one spring tab on the male slider insertable within the cavity of the female body for providing stability of the connective arrangement.

5. An electrical connective arrangement as described in claim 1 wherein the female housing has terminals to connect with the flexible circuit on opposing sides of the male slider platform.

6. An electrical connective arrangement as described in claim 1 wherein the platform has attachment bumps which fit within apertures of the flexible circuit to help attach the flexible circuit to the male slider.

7. An electrical connective arrangement as described in claim 1 wherein the second structure has a socket which a nail of the finger fits into to position the male slider.

8. An electrical connective arrangement for mating an electrical component with on a first structure to a flexible circuit, the flexible circuit being positioned adjacent a second structure, the second structure having a first and second surface penetrated by a generally T-shaped slot and the flexible circuit being primarily on a second side of the second structure opposite the first structure, the arrangement comprising:

a male slider, the male slider having a platform projecting in a first direction, the platform providing on both sides presentation surfaces for the flexible circuit, the slider also having at both ends sets of fingers juxtaposing the second structure, at least one of the fingers being compliant and wherein the male slider is inserted into the T-shaped slot and moved until the fingers juxtapose the first and second sides of the second structure, and the male slider also having along both ends alignment posts, and the slider also having a spring tab;

a female housing connected with the electrical component, the female housing having a cavity to receive the platform, spring tab and alignment post of the male slider, the female housing having spring terminals facing one another for contacting with the flexible circuit and wherein movement of the electrical device in a second direction opposite the first direction toward the second structure causes the slider to move in a plane generally parallel with the second structure to align the male slider with the female housing and to establish the electrical connection between the flexible circuit and the electrical device.

* * * * *